US011339552B2

(12) United States Patent
Salz et al.

(10) Patent No.: US 11,339,552 B2
(45) Date of Patent: May 24, 2022

(54) SKID SEGMENT FOR AN EDGE PROTECTION ON A ROAD MILLING MACHINE AND EDGE PROTECTION FOR A ROAD MILLING MACHINE

(71) Applicant: Wirtgen GmbH, Windhagen (DE)

(72) Inventors: Andreas Salz, Neustadt (DE); Martin Lenz, Großmaischeid (DE); Cyrus Barimani, Königswinter (DE)

(73) Assignee: Wirtgen GmbH

( * ) Notice: Subject to any disclaimer, the term of this patent is extended or adjusted under 35 U.S.C. 154(b) by 459 days.

(21) Appl. No.: 16/462,903

(22) PCT Filed: Nov. 16, 2017

(86) PCT No.: PCT/EP2017/079396
§ 371 (c)(1),
(2) Date: May 21, 2019

(87) PCT Pub. No.: WO2018/104015
PCT Pub. Date: Jun. 14, 2018

(65) Prior Publication Data

US 2020/0080280 A1 Mar. 12, 2020

(30) Foreign Application Priority Data

Dec. 7, 2016 (DE) ..... 102016123662.4

(51) Int. Cl.
*E02F 3/00* (2006.01)
*E02F 3/815* (2006.01)
*E01C 23/088* (2006.01)

(52) U.S. Cl.
CPC ..... *E02F 3/8157* (2013.01); *E01C 23/088* (2013.01); *E01C 2301/20* (2013.01)

(58) Field of Classification Search
CPC ... E02F 3/8157; E01C 23/088; E01C 2301/20
(Continued)

(56) References Cited

U.S. PATENT DOCUMENTS 348,941 A 9/1886 Witt
371,516 A 10/1887 Nuckols
(Continued)

FOREIGN PATENT DOCUMENTS

CN 202644265 U 1/2013
CN 104972883 A 10/2015
(Continued)

OTHER PUBLICATIONS

International Search Report of corresponding International patent application No. PCT/EP2017/079396, dated Feb. 7, 2018, 11 pages (not prior art).
(Continued)

*Primary Examiner* — Raymond W Addie
(74) *Attorney, Agent, or Firm* — Lucian Wayne Beavers; Patterson Intellectual Property Law, PC

(57) ABSTRACT

The invention relates to a skid segment (10) for an edge protection (5) on a road milling machine or similar ground processing machine having a base part (11) and at least one first skid section (12) mounted thereupon, wherein the first skid section (12), in a first operating position of the base part (11), can be directed in direction (A) onto the surface of the road or ground. At least one second skid section (13) is mounted on the base part (11), which, in a second operating position of the base part (11), can be directed in direction (A) onto the surface of the road or ground. The invention further relates to an edge protection for a road milling machine or similar ground processing machine having skid segments of this kind, wherein the edge protection has an edge which is designed to receive at least one skid segment.

20 Claims, 11 Drawing Sheets

(58) Field of Classification Search
USPC ..... 404/82–100, 118
See application file for complete search history.

(56) References Cited

U.S. PATENT DOCUMENTS

| | | | | |
|---|---|---|---|---|
| 893,371 | A | 7/1908 | Raper | |
| 964,412 | A | 7/1910 | Faris | |
| 1,106,278 | A | 8/1914 | Brumfield | |
| 1,463,641 | A | 7/1923 | Ward et al. | |
| 2,249,872 | A | 7/1941 | Turner | |
| 2,835,517 | A | 5/1958 | Beerli | |
| 3,041,752 | A | 7/1962 | Evans | |
| 3,320,688 | A * | 5/1967 | Haban | E01H 5/098 37/242 |
| 4,395,156 | A * | 7/1983 | Sprague, III | E01C 19/185 172/817 |
| 4,441,266 | A * | 4/1984 | Westimayer | E01H 5/098 172/393 |
| 4,483,515 | A | 11/1984 | Maryonovich | |
| 4,716,666 | A | 1/1988 | Potter | |
| 5,056,243 | A | 10/1991 | Sprunger et al. | |
| 5,063,695 | A | 11/1991 | Briscoe et al. | |
| 5,489,162 | A | 2/1996 | LoCicero et al. | |
| 6,238,134 | B1 * | 5/2001 | Sovik | E01C 19/4893 404/118 |
| 6,283,672 | B1 * | 9/2001 | Sovik | E01C 19/48 404/118 |
| 6,431,249 | B1 | 8/2002 | Tabellini | |
| 6,682,254 | B1 | 1/2004 | Olofsson et al. | |
| 7,451,558 | B2 | 11/2008 | Jones | |
| 7,897,005 | B2 | 3/2011 | Knauseder | |
| 7,909,534 | B1 * | 3/2011 | Comer | E01C 19/42 404/118 |
| 8,177,456 | B2 | 5/2012 | Haroldsen | |
| 8,191,289 | B2 * | 6/2012 | Raftery | E01H 5/12 37/271 |
| 8,584,383 | B1 | 11/2013 | Morse et al. | |
| 8,640,570 | B2 | 2/2014 | Viola et al. | |
| 8,757,923 | B1 * | 6/2014 | Comer | E01C 19/48 404/104 |
| D726,775 | S | 4/2015 | Ley et al. | |
| D726,776 | S | 4/2015 | Ley et al. | |
| D726,777 | S | 4/2015 | Ley et al. | |
| 9,089,087 | B2 | 7/2015 | Ley et al. | |
| 9,243,376 | B2 * | 1/2016 | Guggino | E01H 5/066 |
| 9,556,572 | B2 * | 1/2017 | Duchscherer | E01H 5/098 |
| 9,598,829 | B2 * | 3/2017 | Betts | E01H 5/098 |
| 9,637,875 | B2 | 5/2017 | Losen et al. | |
| 9,745,705 | B2 | 8/2017 | Ley et al. | |
| 10,260,207 | B2 | 4/2019 | Ley et al. | |
| 2006/0150444 | A1 * | 7/2006 | Friberg | B62D 11/08 37/244 |
| 2007/0235202 | A1 | 10/2007 | Mullett | |
| 2009/0185859 | A1 | 7/2009 | Haroldsen | |
| 2009/0232598 | A1 | 9/2009 | Cochran et al. | |
| 2010/0209190 | A1 * | 8/2010 | Munz | E01C 19/48 404/118 |
| 2011/0315465 | A1 | 12/2011 | Henry | |
| 2016/0122953 | A1 * | 5/2016 | Comer | E01C 19/48 404/118 |
| 2016/0122954 | A1 * | 5/2016 | Comer | E01C 19/48 404/118 |
| 2017/0101756 | A1 | 4/2017 | Zhang et al. | |

FOREIGN PATENT DOCUMENTS

| | | | |
|---|---|---|---|
| DE | 102012103440 | A1 | 10/2013 |
| DE | 102013015873 | A1 | 3/2014 |
| DE | 102014007907 | A1 | 12/2014 |
| JP | 2009185859 | A | 8/2009 |
| TW | 341892 | B2 | 10/1998 |

OTHER PUBLICATIONS

China Search Report for corresponding patent application No. CN 2017111907849, dated Sep. 12, 2019, 3 pages (not prior art).
Russia Search Report for corresponding patent application No. 2019104072/03, dated Nov. 11, 2017, 2 pages (not prior art).

* cited by examiner

SKID SEGMENT FOR AN EDGE PROTECTION ON A ROAD MILLING MACHINE AND EDGE PROTECTION FOR A ROAD MILLING MACHINE

The invention relates to a skid segment for an edge protection on a road milling machine or similar ground working machine, having a base part and at least one first skid section attached thereto, wherein, in a first operating position of the base part, the first skid section can be aligned in a direction onto the road or ground surface.

The invention furthermore relates to an edge protection for a road milling machine or similar ground working machine, having at least one skid segment of this kind, wherein the edge protection has an edge, which is designed to receive at least one skid segment.

Road milling machines are used in road and path construction. They serve to remove the existing pavement completely or partially. In this case, a milling drum is used, which is accommodated in a protected manner within a milling case. The milling drum is generally fitted with bits, which dig into the underlying surface to be worked in order to remove the pavement. Protective elements, referred to as edge protections, are used on the milling case sides, which extend in the travel or feed direction of the road milling machine. The edge protection covers the milling drum at the sides and thus prevents access to the milling drum during milling, on the one hand, and prevents milled material from being ejected into the environment, on the other hand. The edge protection rests on the pavement surface by means of a lower skid, and therefore the milling drum is completely covered. Moreover, the skid is pressed hydraulically onto the unworked pavement, which subsequently rests on the milling drum outside the work zone in order to ensure a clean cutting edge and to avoid clod-type fragments.

US 2009/0185859 A1 discloses a road milling machine that has an edge protection of this kind. An integral skid extending in the feed direction forms the skid and is attached detachably and thus interchangeably to the edge protection by means of screwed joints.

DE 10 2012 103 440 A1 likewise discloses a road milling machine having an edge protection and a skid segment for an edge protection of this kind. Here, the skid of this road milling machine is made up of a plurality of skid segments, which are subject to a certain wear and must therefore be replaced after they reach their wear limit. For this purpose, the skid segment has a plug-in projection, which can be inserted into a plug socket of the edge protection, thus enabling it to be replaced easily in harsh construction-site operation when the wear limit is reached.

After appropriate wear, the known skid segments are completely replaced and then disposed of or taken for recycling or reprocessing. The time in which the known skid segments can be used without interruption, that is to say the service life of the skid segments, is limited by the occurrence of considerable wear phenomena, which then require complete replacement of the skid segments. The worn skid segments are then usually disposed of or taken for recycling or reprocessing. New skid segments must be replaced after just one period of service. The use of materials that is involved in skid segments that have to be replaced is accordingly high over the life of the road milling machine.

It is an object of the invention to provide a skid segment for an edge protection of a road milling machine or similar ground working machine which enables a longer period of use than the conventional skid segments, thereby reducing the required use of materials and simplifying maintenance.

It is furthermore an object of the invention to provide an edge protection of the abovementioned type which promotes simple and low-cost maintenance.

The object of the invention is achieved by a skid segment for an edge protection in accordance with the features of patent claim 1 and by an edge protection in accordance with the features of patent claim 16. Advantageous developments are described in the respective dependent claims.

Accordingly, at least one second skid section is attached to the base part of the skid segment, and, in a second operating position of the base part, can be aligned in a direction toward the road or ground surface. In the first operating position, therefore, the first skid section comes into direct contact with the road or ground surface and undergoes the abrasion which occurs during the operation of the road milling or ground working machine. When the first skid section has reached its wear limit, the skid segment is moved from the first to the second operating position, in which the second skid segment comes into direct contact with the road or ground surface. Thus, it is only after the second skid section has worn that the skid segment has to be completely replaced. The period of use of the skid segment is thus significantly extended and it is only after a double period of service that new material has to be used. This also simplifies the maintenance effort since remounting from the first to the second operating position involves less effort than a complete replacement of the skid segment.

It is also conceivable for a total of three or four skid sections to be attached to the base part and, accordingly, for there to be three or four possible different operating positions. By means of a skid segment of this kind, the period of use would be extended even further, and the maintenance effort would be even further simplified.

According to a basic concept of the invention, the at least one first skid section can be attached to a first side of the base part, in the lower region thereof. In this case, the base part can have a second side, which faces away from the first side and forms a fastening side having at least one supporting surface. It is thus a simple matter, in the first operating position, for the skid segment to be brought into contact with the second side of the base part, e.g. on the lower edge region of an edge protection for a road milling or ground working machine, and to be secured there, wherein the first skid section can be brought into direct contact with the road or ground surface in the lower region of the opposite first side of the base part in the first operating position, thus forming at least part of a skid.

According to a further-reaching concept of the invention, the at least one second skid section can be attached to the first side of the base part, in the upper region thereof, wherein the first and second skid sections form a profile with a substantially U-shaped cross section together with the base part. By transferring the skid segment from the first operating position to a second operating position, which is pivoted through 180°, e.g. about the longitudinal axis thereof as the pivoting axis, the second skid section on the upper region of the first side of the base part can be brought into direct contact with the road or ground surface, wherein the second side is furthermore in contact with the lower edge region of the edge protection, for example. As an alternative, pivoting from the first to the second operating position, also through 180°, about a transverse axis of the skid segment is possible. As a further alternative, pivoting about any desired pivoting axis is possible, with the skid segment being moved from the first to the second operating position, wherein the skid segment can be mounted in such a way as to be inverted in the second operating position, relative to the first operating position. By means of this construction, it is a simple matter to move the skid segment from the first to a second operating position and thus to extend the period of use of the skid segment.

In order to increase the rigidity of the skid segment, at least one reinforcing strut can be arranged between the first skid section and the second skid section, alternatively or additionally at an angle between the first skid section and the base part, and, as a further alternative or additional feature, at an angle between the second skid section and the base part. Moreover, the first and second skid sections projecting on the first side of the base part, in interaction with the reinforcing struts, protect fastening elements arranged therebetween, e.g. screw heads or screw nuts, from excessive wear or shock fracture, e.g. on curbstone edges.

In order to allow particularly easy sliding of the skid segment on the road or ground surface, the first skid section and the second skid section can taper toward one another along a curved path, at least at the first end, which faces in the feed direction, and the first and second skid sections can form a tapered first end together with the base part. As part of the skid, the skid segment can thus form a skid tip which is curved upward away from the ground surface and, for example, slides up onto gravel or rock fragments and thus prevents the feed motion from being blocked. Here, two skid segments having a tapered first end, attached on both sides to the edge protection of a milling case, for example, are not only moved from the first to the second operating position by pivoting through 180° but are additionally exchanged with the identically constructed skid segment attached to the opposite side of the milling case. Thus, both skid sections can be worn alternately in order to extend the time in use.

In a particularly advantageous embodiment, the skid segment can be of symmetrical design with respect to the central longitudinal plane, which extends in the longitudinal direction. By means of this measure, the skid segment can be moved from the first to a second operating position simply by pivoting through 180°, e.g. about the longitudinal axis or a transverse axis as the pivoting axis.

According to another preferred embodiment, the at least one first skid section can be attached to the second side, which faces away from the first side, of the base part, in the lower region thereof. In this case, the second side of the base part can form a fastening side having at least one supporting surface in the first operating position. It is thus a simple matter, in the first operating position, for the skid segment to be brought into contact with the second side of the base part, e.g. on the lower edge region of an edge protection for a road milling or ground working machine, and to be secured there, wherein, in the first operating position, the first skid section fits around the edge protection at the bottom in the lower region of the second side of the base part. The first skid section thus protects the edge protection effectively from wear on the underside.

The at least one second skid section can be attached in the upper region of the first side, wherein the first and second skid sections form a profile with a substantially Z-shaped cross section together with the base part. In this embodiment, the skid segment can be moved from the first operating position to the second operating position simply by transfer or pivoting, e.g. about the longitudinal axis or a transverse axis as the pivoting axis.

In a development according to the invention, at least one reinforcing strut can in each case be arranged at an angle between the first skid section and the base part and/or at an angle between the second skid section and the base part. In the case of the skid segment with a Z-shaped cross section, these reinforcing struts serve for reinforcement and, for example, protect screw heads or screw nuts attached to the base part from abrasion or shock fracture since they project beyond the first and the second side of the base part.

In order to make sliding on the road or ground surface easier in the case of a skid segment with a Z-shaped cross section, the second skid section can extend along a curved path in a direction toward the first skid section at the first end, which faces in the feed direction, and the first skid section can extend along a curved path in a direction toward the second skid section at the second end, which faces counter to the feed direction. In this case, the base part can be designed to follow the course of the second and the first skid section, preferably at the first and the second end.

In a particularly advantageous embodiment, the geometrical body of the skid segment can be of point-symmetrical design with respect to the center of the body. By virtue of this shaping, the skid segment can be moved from the first to a second operating position simply by pivoting, wherein the first or the second skid section is part of the slide rail in each case.

In a particularly rigid and simple-to-produce embodiment, the base part can form a profile of rectangular cross section extending along at least some section or sections of the edge protection.

For the stable and detachable fastening of the skid segment on the edge protection, at least one screw socket can be formed in the base part. Fastening screws can be inserted into these screw sockets and are, in turn, secured on the edge protection.

In order to attach the skid segment at a variable height relative to the edge protection, the screw socket can be designed as a slotted hole extending substantially perpendicularly or transversely to the central longitudinal plane. Simply by vertical adjustment along the slotted hole, the position of the skid segment can be adapted to the vertical position of the edge protection above the road or ground surface.

According to yet another preferred embodiment, the base part can have two regions that are drawn in laterally, said regions each merging into two inward-sloping partial regions from the first skid section in the direction of the second skid section and from the second skid section in the direction of the first skid section. The two laterally drawn-in regions are each of substantially V-shaped design and are used for alternative or additional fastening on the edge protection. For this purpose, plug sockets are provided on the edge protection, these being in engagement with the respective inward-sloping partial regions of the laterally drawn-in regions and forming an easy-to-release plug-in joint for the skid segment.

Two substantially parallel partial regions can be formed between each of the two inward-sloping partial regions. These parallel partial regions are out of engagement with the plug sockets during the assembly and disassembly process and thus allow the changing or transfer of the skid segment.

According to the invention, the edge of the edge protection has corresponding fastening sockets for receiving the at least one skid segment. In this case, the fastening sockets can be arranged substantially along the edge of the edge protection in order to receive a plurality of skid segments that together form a slide rail.

According to an advantageous embodiment, the fastening sockets for the skid segments can comprise at least one screw socket. In order to form a releasable fastening of the skid segments on the edge protection, fastening screws can be introduced into these screw sockets, the screws being introduced into screw sockets formed in the base parts of the skid segments.

In order to provide a level contact surface between the edge protection and a skid segment of Z-shaped cross section attached thereto, the fastening sockets for the skid segments can comprise at least one socket for the reinforcing struts of the skid segments.

In order to offer effective wear protection for the edge of the edge protection, the skid segments of Z-shaped cross section can be attached to the edge protection in such a way that, in the first operating position, the first skid section covers the edge of the edge protection at the bottom and, in the second operating position, the second skid section covers the edge of the edge protection at the bottom.

In order to offer effective wear protection for the edge of the edge protection, it is possible, in the case of skid segments of U-shaped cross section, for the first skid section to project beyond the edge of the edge protection in a direction toward the road or ground surface in the first operating position. In the second operating position, the second skid section can project beyond the edge of the edge protection in a direction toward the road or ground surface.

According to a further-reaching embodiment, the fastening sockets for the skid segments can comprise at least one plug socket for the positive retention of at least one skid segment. In the two different operating positions, these plug sockets of the skid segments can each be in engagement with the inward-sloping partial regions of the laterally drawn-in regions and form a simple-to-release plug-in joint.

In an advantageous manner, the plug sockets can have two mutually spaced clamping elements, which act on both sides on the inward-sloping partial regions of the base part.

During the installation of the skid segments, the clamping elements come into engagement with the inward-sloping partial regions of the laterally drawn-in regions, thereby creating a stable and yet releasable joint.

Secure seating of the skid segments on the edge protection can be achieved if the clamping elements have stop surfaces which extend substantially parallel to the inward-sloping partial regions of the base part, and the base part of the skid segment has at least partially enclosing undercuts.

The invention is explained in greater detail below by means of illustrative embodiments illustrated in the drawings, in which.

Figure 1:
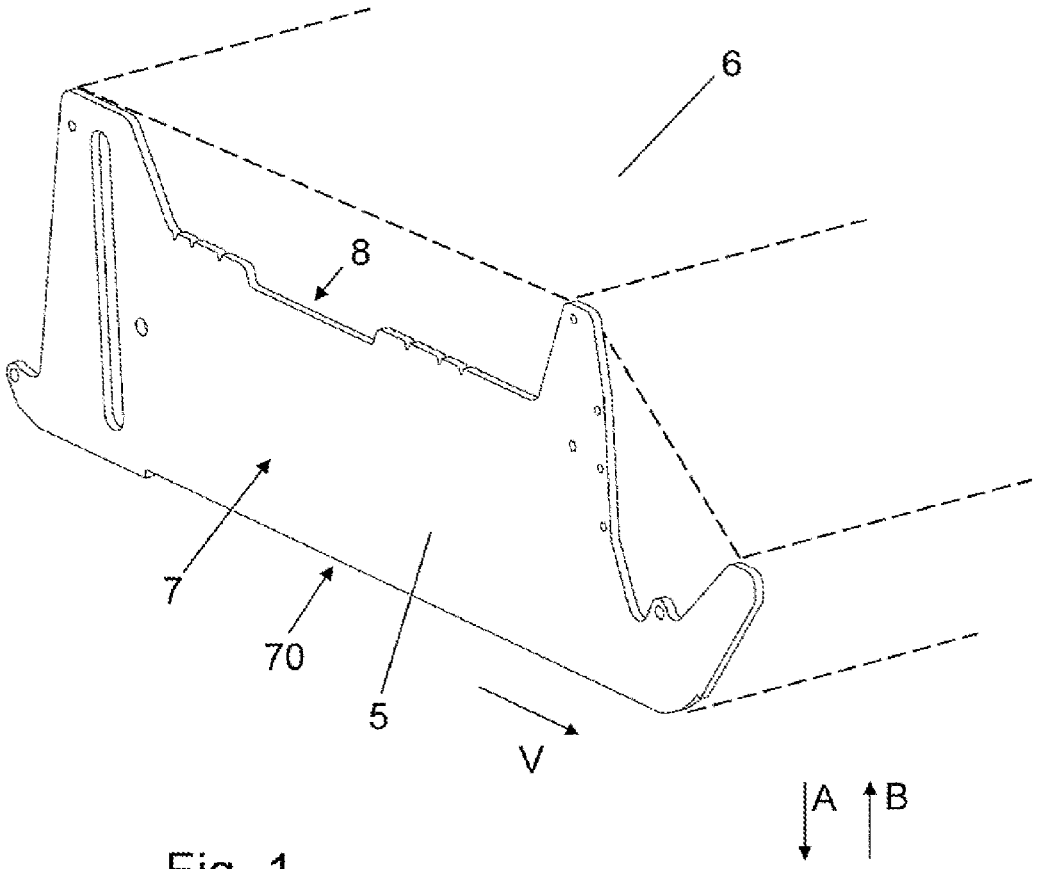
FIG. 1 shows an embodiment of an edge protection of the milling case of a road milling machine in a schematic and perspective side view.

FIG. 1 shows, in a schematic and perspective side view, an embodiment of an edge protection 5, designed in the manner of a plate, of a milling case 6, merely indicated in FIG. 1, of a road milling machine. The edge protection 5 has an inner side 8 for coupling to the road milling machine in the region of the milling case and an outer side 7. In the lower region, the edge protection 5 has an edge 70. The edge protection 5 is of elongate design in the feed direction V of the road milling machine, wherein the edge 70 extends in the feed direction V and substantially parallel to a road or ground surface (not shown).

Figure 2:
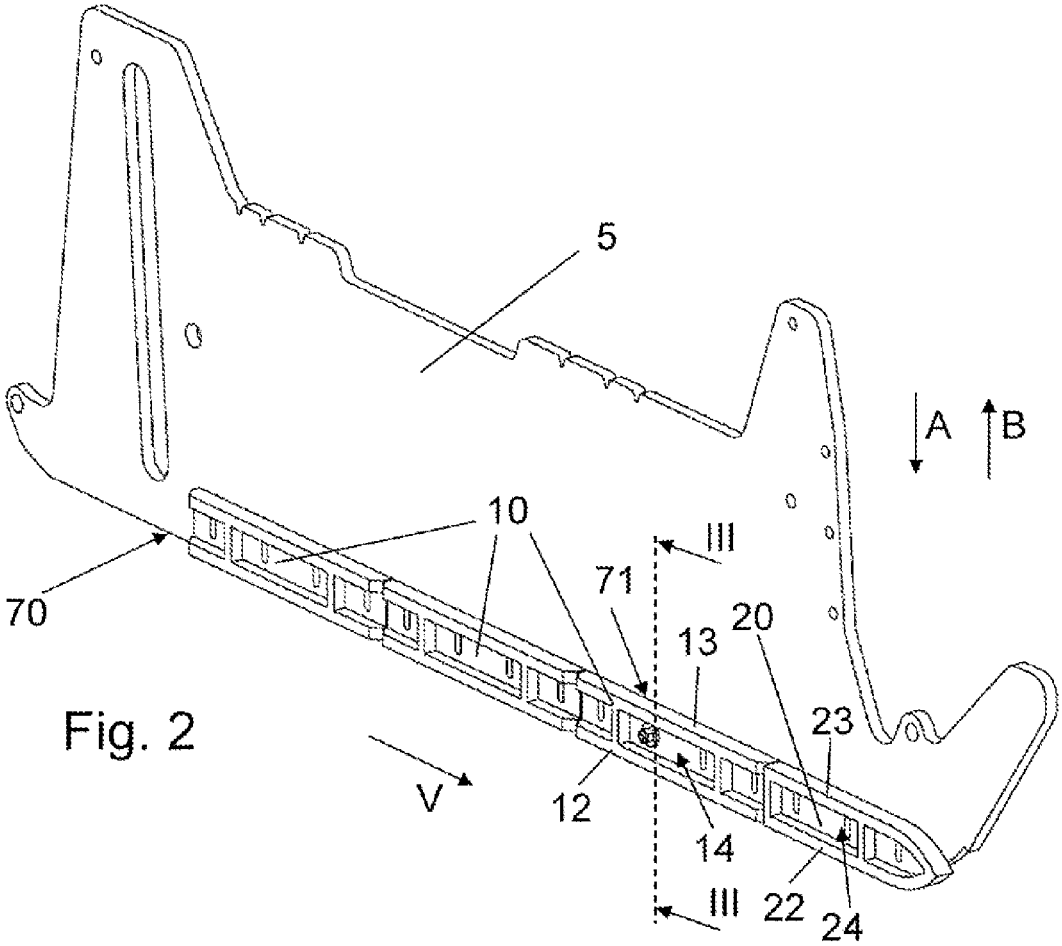
FIG. 2 shows the edge protection shown in FIG. 1 with four skid segments according to a first embodiment arranged in series on its lower edge in a schematic and perspective side view.

FIG. 2 shows the edge protection 5 shown in FIG. 1 with four skid segments 10 and 20 according to a first embodiment arranged in series on its lower edge 70 in a schematic and perspective side view. The skid segment 20 arranged at the front end of the edge 70 in the feed direction V has a tapered front end, whereas the three adjoining skid segments 10 counter to the feed direction V are of substantially straight design. The skid segments 10 and 20 are mounted in a first operating position. The edge protection 5 may also be referred to as a side plate for the milling case of the road milling machine. The edge protection 5 and the skid segments 10 and 20 may also be referred to as a side plate assembly.

The edge 70 has a plurality of fastening sockets, which are spaced apart from one another along the edge 70 and from the latter in direction B and of which only one fastening socket for receiving one of the skid segments 10 is illustrated in FIG. 1. The fastening socket for this skid segment 10 has a screw socket 71.

The skid segment 10 is described in greater detail below with reference to FIGS. 3, 4 and 5.

Figure 3:
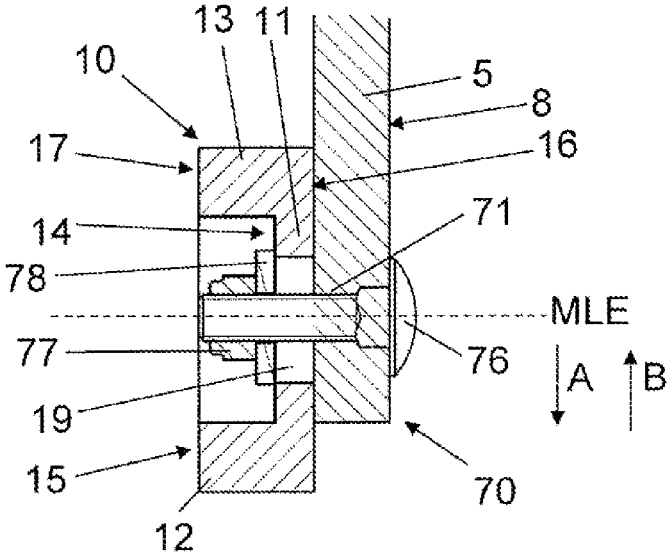
FIG. 3 shows the region of a fastening socket of a skid segment shown in FIG. 2 in a schematic sectional view along section line III-III.

FIG. 3 shows the region of the fastening socket of the skid segment 10 shown in FIG. 2 in a schematic sectional view along section line III-III.

In FIG. 3, the skid segment 10 is illustrated as mounted in a first operating position. The skid segment 10 has a base part 11 of substantially rectangular cross section. A first skid section 12 is arranged on the lower side of the base part 11, and a second skid section 13 is arranged on the upper side thereof, said sections projecting at right angles from the base part 11 beyond the first side 14, which is on the left in FIG. 3. The base part 11 is formed integrally with the first and the second skid section 12 and 13 from a metal, preferably cast steel. The lower side of the first skid section 12 and the upper side of the second skid section 13 are of substantially level design.

The base part 11 has a second side 16, which faces away from the first side 14 and, irrespective of the operating position, forms a fastening side having at least one supporting surface. By means of the second side 16, the base part 11 rests against the edge 70 of the edge protection 5 and is mounted thereon. In the first operating position shown in FIG. 3, the first skid section 12 projects beyond the edge 70 of the edge protection 5 in the direction A of the road or ground surface.

A screw socket 19, which is introduced into the base part 11 as a drill hole with a drilling direction substantially parallel to the central longitudinal plane MLE, is formed in the base part 11 in the region between the first and the second skid section. In this case, the screw socket 19 is designed as a slotted hole which, in turn, extends substantially perpendicularly to the central longitudinal plane MLE or transversely thereto. A screw socket 71 of the edge protection 5 in alignment with the screw socket 19 of the base part 11 is formed on the edge 70 of the edge protection 5 and spaced apart therefrom in direction B. A fastening screw 76 is introduced through the two screw sockets 71 and 19 from the inner side 8 of the edge protection 5 and is secured on the first side 14 of the base part by means of a nut 77. A washer 78 is inserted between the base part 11 and the nut 77.

The skid segment 10 can also be mounted in a second operating position (not shown). In the second operating position, the skid segment 10 is rotated through 180° or mounted in such a way as to be inverted as compared with the first operating position shown in FIG. 3. As a result, the first skid section 12 faces upward in direction B in the second operating position, whereas the second skid section 13 faces downward in direction A. In the second operating position, the second skid section 13 thus projects beyond the edge 70 of the edge protection 5 in the direction A of the road or ground surface.

Figure 4:
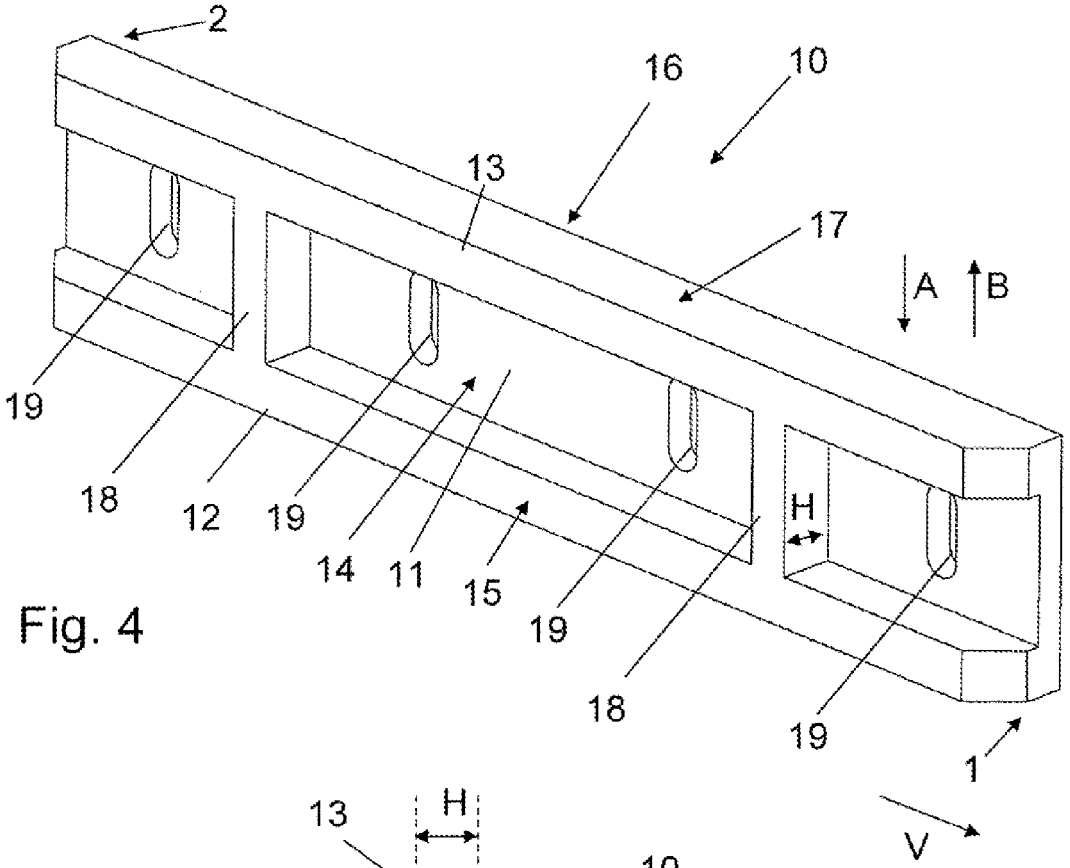
FIG. 4 shows a skid segment shown in FIG. 2 and having mutually parallel skid sections in a schematic and perspective side view.

FIG. 4 shows a skid segment 10 shown in FIG. 2 and having mutually parallel first and second skid sections 12 and 13 in a schematic and perspective side view.

In the orientation, shown in FIG. 4, of the first operating position, the first skid section 12 attached to the first side 14 of the base part 11, on the lower region 15 thereof, is aligned in the direction A of the road or ground surface. In the orientation, shown in FIG. 4, of the first operating position, the second skid section 13 attached to the first side 14 of the base part 11, on the upper region 17 thereof, is aligned in the direction B away from the road or ground surface. In the second operating position, which is not shown in FIG. 4, the second skid section 13 would be aligned in the direction A of the road or ground surface.

Two reinforcing struts 18, which extend perpendicularly to the first and the second skid section 12 and 13 and are spaced apart from one another in the feed direction V, are arranged on the skid segment 10, between the first skid section 12 and the second skid section 13. The reinforcing struts 18 project relative to the base part 11 at the same height H as the first and the second skid section 12 and 13 project relative to the base part 11. The reinforcing struts 18 are spaced apart from the two ends of the skid segment 10 in the feed direction V. At both ends 1 and 2 of the skid segment 10, the first skid section 12 and the second skid section 13 are of beveled design perpendicularly to the feed direction V.

A total of four screw sockets 19 spaced apart from one another in the feed direction V is formed in the base part 11 on both sides of the reinforcing struts 18. The screw sockets 19 are designed as slotted holes extending substantially perpendicularly to the central longitudinal plane MLE of the skid segment 10, said plane extending in the longitudinal direction.

Figure 5:
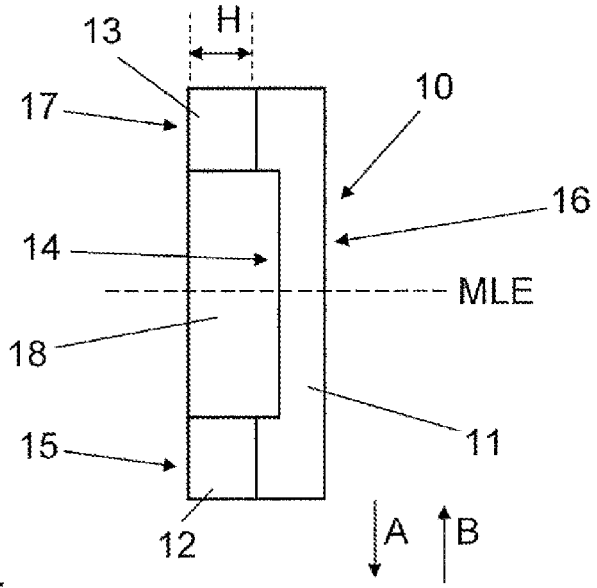
FIG. 5 shows the skid segment shown in FIG. 4 in a schematic front view counter to the feed direction.

FIG. 5 shows the skid segment 10 shown in FIG. 4 in a schematic front view, counter to the feed direction V, said skid segment being formed symmetrically with respect to the central longitudinal plane MLE. The first skid section 12 is attached to the first side 14 of the base part 11 of the skid segment 10, in the lower region 15 thereof, and the second skid section 13 is attached in the upper region 17 thereof. In this case, the first and second skid sections 12 and 13 form a profile of substantially U-shaped cross section together with the base part 11. The base part 11 forms a profile of rectangular cross section extending along the edge protection 5.

Figure 6:
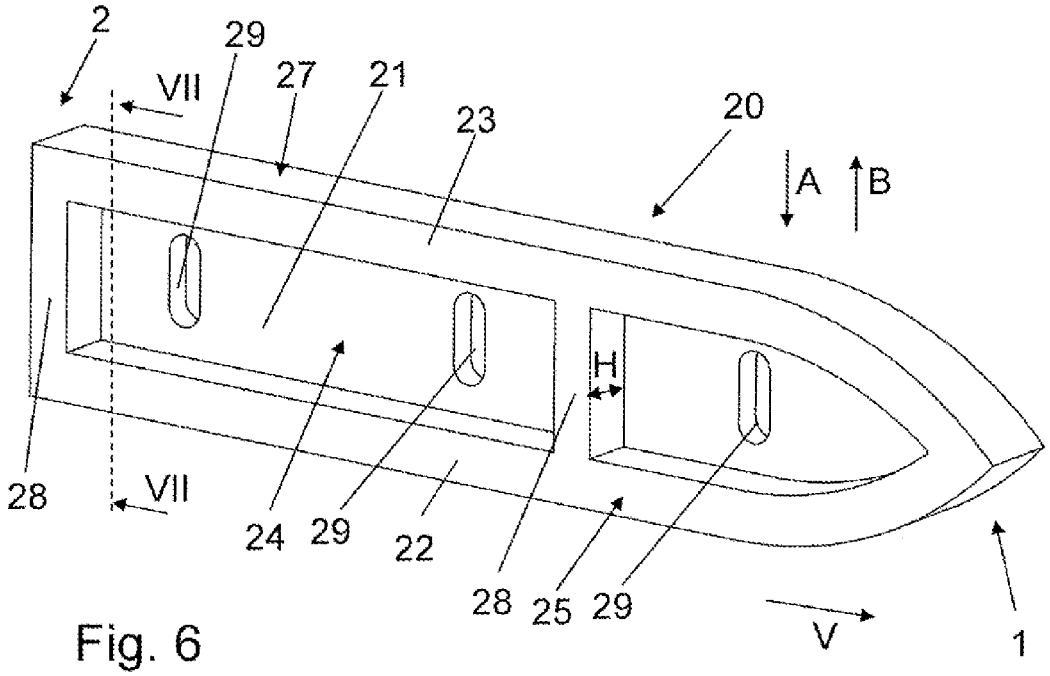
FIG. 6 shows the skid segment shown in FIG. 1 and having a tapered first end in a schematic and perspective side view.

FIG. 6 shows the skid segment 20 shown in FIG. 1 and having a tapered first end 1 in a schematic and perspective side view.

In the orientation, shown in FIG. 6, of the first operating position, the first skid section 22 attached to the first side 24 of the base part 21, on the lower region 25 thereof, is aligned in the direction A of the road or ground surface. In the orientation, shown in FIG. 6, of the first operating position, the second skid section 23 attached to the first side 24 of the base part 21, on the upper region 27 thereof, is aligned in the direction B away from the road or ground surface. In the second operating position, which is not shown in FIG. 6, the second skid section 23 would be aligned in the direction A of the road or ground surface.

At the first end 1, which faces in the feed direction V, the first skid section 22 and the second skid section 23 taper toward one another along a curved path and form a tapered first end 1 together with the base part 21. The section of the second skid section 23 in the region of the second end 2 extends parallel to the section of the first skid section 22 in the region of the second end 2. Here, the shape of the base part 21 follows the converging paths of the first and the second skid section 22 and 23.

Two reinforcing struts 28, which extend substantially perpendicularly to the mutually parallel sections of the first and the second skid section 22 and 23 and are spaced apart from one another in the feed direction V, are arranged on the skid segment 20, between the first skid section 22 and the second skid section 23. The reinforcing struts 28 project relative to the base part 21 at the same height H as the first and the second skid section 22 and 23 project relative to the base part 21. The reinforcing strut 28 arranged in the region of the front, tapering first end 1 is spaced apart from the first end 1 in the feed direction V. The reinforcing strut 28 arranged at the rear, second end 2 of the skid segment 20 ends with the end of said segment.

Two screw sockets 29 spaced apart from one another in the feed direction V are formed in the base part 21 on both sides of the front reinforcing strut 28, and a third screw socket 29 is formed close to the rear reinforcing strut 28. The screw sockets 29 are introduced into the base part 21 as drill holes with a drilling direction substantially parallel to the central longitudinal plane MLE. The screw sockets 29 are once again designed as slotted holes extending substantially perpendicularly to the central longitudinal plane MLE of the skid segment 20, said plane extending in the longitudinal direction.

Figure 7:
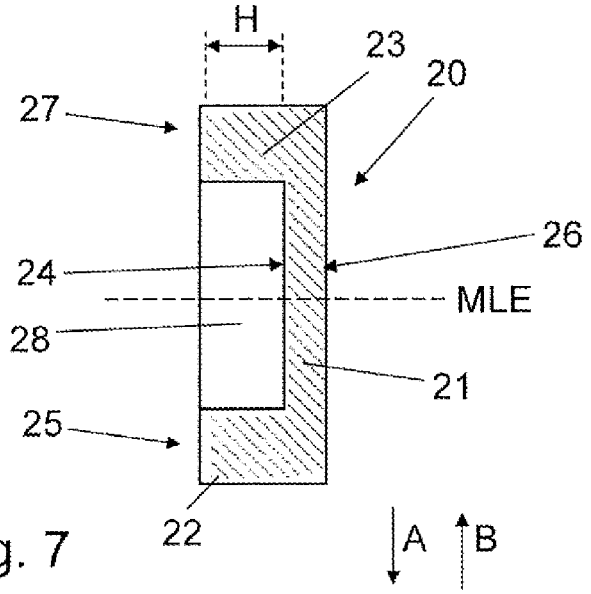
FIG. 7 shows the skid segment shown in FIG. 6 in a schematic sectional view along section line VII-VII.

FIG. 7 shows the skid segment 20 shown in FIG. 6 in a schematic sectional view along section line VII-VII. The skid segment 20 is formed symmetrically with respect to the central longitudinal plane MLE. The first skid section 22 is attached to the first side 24 of the base part 21 of the skid segment 20, in the lower region 25 thereof, and the second skid section 23 is attached in the upper region 27 thereof. In this case, the first and second skid sections 22 and 23 form a profile of substantially U-shaped cross section in the region of section together with the base part 21. The base part 21 forms a profile of rectangular cross section extending along the edge protection 5.

Figure 8:
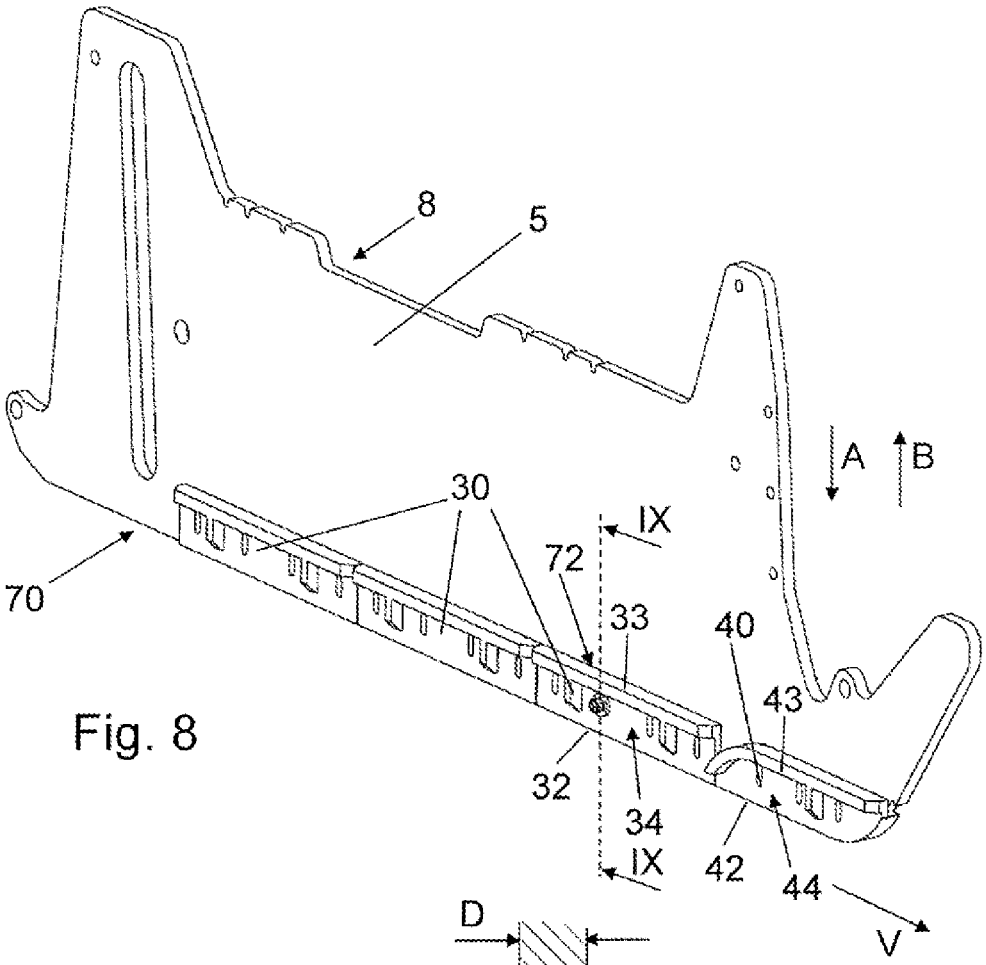
FIG. 8 shows the edge protection shown in FIG. 1 with four skid segments according to a second embodiment arranged in series on its lower edge in a schematic and perspective side view.

FIG. 8 shows the edge protection 5 shown in FIG. 1 with four skid segments 30 and 40 according to a second embodiment arranged in series on its lower edge in a schematic and perspective side view. The skid segment 40 arranged at the front end of the edge 70 in the feed direction V has a tapered front end, whereas the three adjoining skid segments 30 counter to the feed direction V are of substantially straight design. The skid segments 30 and 40 are mounted in a first operating position.

The edge protection 5 has a plurality of fastening sockets, which are spaced apart from one another along the edge 70 and from the latter in direction B and of which only one fastening socket for receiving one of the skid segments 30 is illustrated in FIG. 8. The fastening socket for this skid segment 30 has a screw socket 72. The fastening socket furthermore comprises sockets for reinforcing struts 38; 38', 48 and 48' of skid segments 30 and 40. The reinforcing struts 38; 38', 48 and 48' are described below with reference to FIGS. 10 and 12.

The skid segment 30 is described in greater detail below with reference to FIGS. 9,10 and 11.

Figure 9:
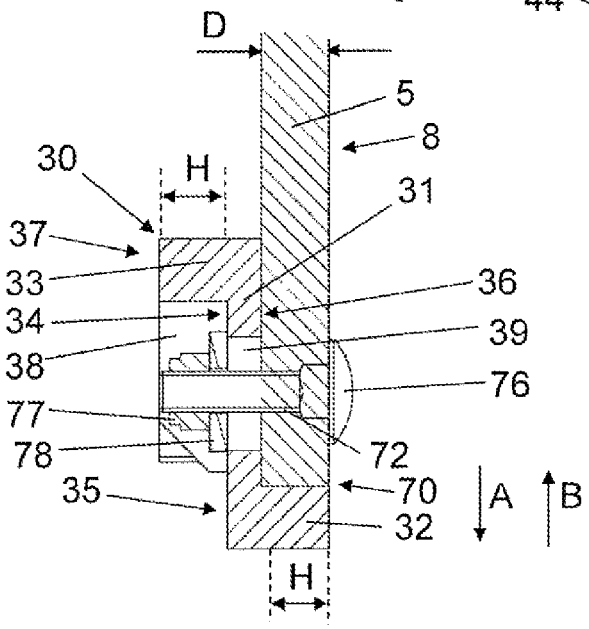
FIG. 9 shows the region of a fastening socket of a skid segment shown in FIG. 8 in a schematic sectional view along section line IX-IX.

FIG. 9 shows the region of the fastening socket 72 of the skid segment 30 shown in FIG. 8 in a schematic sectional view along section line IX-IX.

In FIG. 9, the skid segment 30 is illustrated as mounted in a first operating position. The skid segment 30 has a base part 31 of substantially rectangular cross section. A first skid section 32 is arranged on the bottom of the base part 31, and a second skid section 33 is arranged on the top thereof. The first skid section 32 projects to the right at right angles beyond the second side 36 of the base part 31, the side on the right in FIG. 9. The second skid section 33 projects to the left at right angles beyond the first side 34 of the base part 31, the side on the left in FIG. 9. The base part 31 is formed integrally with the first and the second skid section 32 and 33 from a metal, preferably cast steel. The lower side of the first skid section 32 and the upper side of the second skid section 33 are of substantially level design.

The base part 31 has a second side 36, which faces away from the first side 34 and, in the first operating position shown in FIG. 9, forms a fastening side having a supporting surface. By means of the supporting surface of the second side 36, the base part 31 rests against the edge 70 of the edge protection 5 and is mounted thereon. In the first operating position shown in FIG. 9, the first skid section 32 covers the edge 70 of the edge protection 5 at the bottom relative to the road or ground surface (not shown) situated in direction A.

A screw socket 39, which is introduced into the base part 31 as a drill hole with a drilling direction substantially parallel to the central longitudinal plane MLE, is formed in the base part 31 in the region between the first and the second skid section 32 and 33. In this case, the screw socket 39 is designed as a slotted hole which, in turn, extends substantially perpendicularly to the central longitudinal plane MLE or transversely thereto. A screw socket 72 of the edge protection 5 in alignment with the screw socket 39 of the base part 31 is formed on the edge 70 of the edge protection 5 and spaced apart therefrom in direction B. A fastening screw 76 is introduced through the two screw sockets 72 and 39 from the inner side 8 of the edge protection 5 and is secured on the first side 34 of the base part 31 by means of a nut 77. A washer 78 is inserted between the base part 31 and the nut 77.

The skid segment 30 can also be mounted in a second operating position (not shown). In the second operating position, the skid segment 30 is rotated through 180° or mounted in such a way as to be inverted as compared with the first operating position shown in FIG. 9. As a result, the first skid section 32 faces upward in direction B in the second operating position, whereas the second skid section 33 faces downward in direction A. Thus, in the second operating position, the second skid section 33 covers the edge 70 of the edge protection 5 at the bottom.

The first skid section 32 and the second skid section 33 each project from the base part 31 by a height H, which corresponds to the thickness D of the edge protection 5 in the illustration in FIG. 9. As an alternative, the height H selected can also be greater or smaller than the thickness D.

Figure 10:
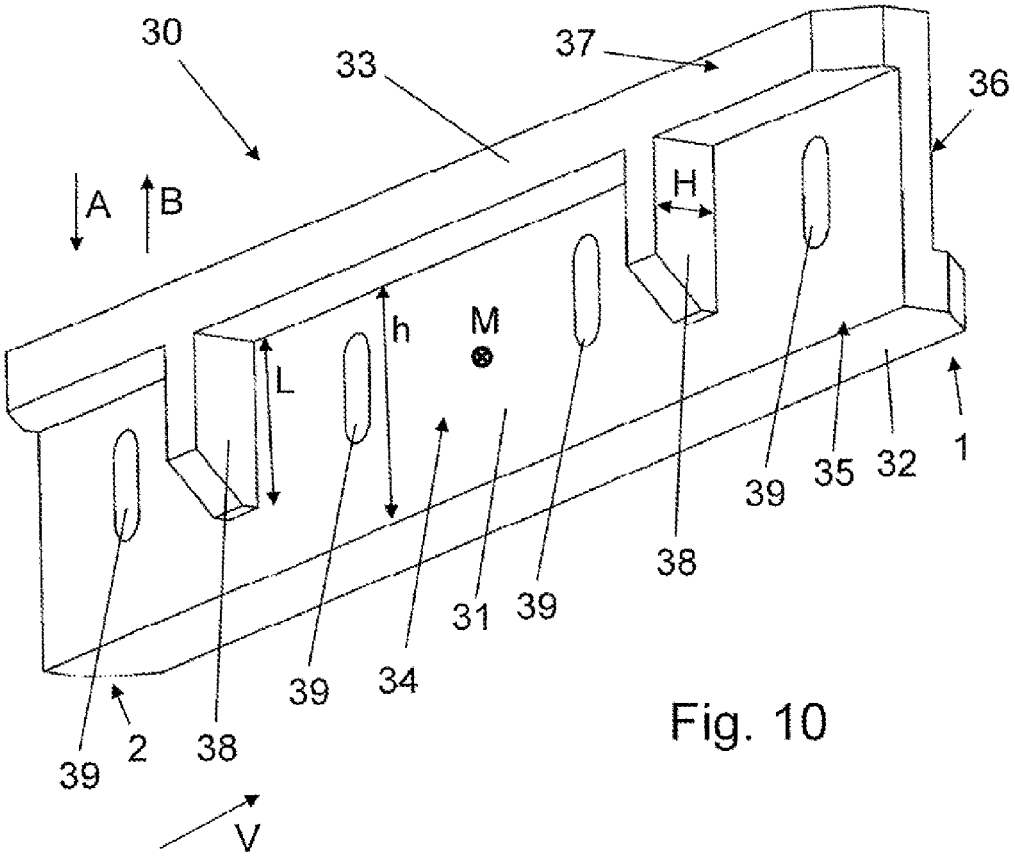
FIG. 10 shows a skid segment shown in FIG. 8 and having mutually parallel skid sections in a schematic and perspective side view.

FIG. 10 shows a skid segment 30 shown in FIG. 8 and having first and second skid sections 32 and 33 in a schematic and perspective side view.

In the orientation, shown in FIG. 10, of the first operating position, the first skid section 32 attached to the first side 34 of the base part 31, on the lower region 35 thereof, is aligned in the direction A of the road or ground surface and extends rearward, projecting at right angles from the base part 31, on the second side 36. In the orientation, shown in FIG. 10, of the first operating position, the second skid section 33 attached to the first side 34 of the base part 31, on the upper region 37 thereof, is aligned in the direction B away from the road or ground surface and extends forward, projecting at right angles from the base part 31, on the first side 34. In the second operating position, which is not shown in FIG. 10, the second skid section 33 would be aligned in the direction A of the road or ground surface.

Two reinforcing struts 38, which are spaced apart from one another in the feed direction V, are arranged on the skid segment 30, between the second skid section 33 and the base part 31, on the first side 34 of the base part 31. The reinforcing struts 38 project relative to the base part 31 at the same height H as the second skid section 33 projects relative to the base part 31. The reinforcing struts 38 extend perpendicularly to the second skid section 33 over a length L which is shorter than the height h of the first side 34 of the base part 31 perpendicularly to the second skid section 33.

Two reinforcing struts 38', which are spaced apart from one another in the feed direction V, are likewise arranged on the skid segment 30, between the first skid section 32 and the base part 31, on the second side 36 of the base part 31. In the illustration in FIG. 10, however, these reinforcing struts are not visible since they are concealed by the base part 31. However, one of the reinforcing struts 38' is illustrated in FIG. 11.

The reinforcing struts 38 are spaced apart from the two ends 1 and 2 of the skid segment 30 in the feed direction V and counter to the feed direction V, respectively. At both ends 1 and 2 of the skid segment 30, the first skid section 32 and the second skid section 33 are of beveled design perpendicularly to the feed direction V.

A total of four screw sockets 39 spaced apart from one another in the feed direction V is formed in the base part 31 on both sides of the reinforcing struts 38. The screw sockets 39 are designed as slotted holes extending substantially perpendicularly to the central longitudinal plane MLE of the skid segment 30, said plane extending in the longitudinal direction.

Figure 11:
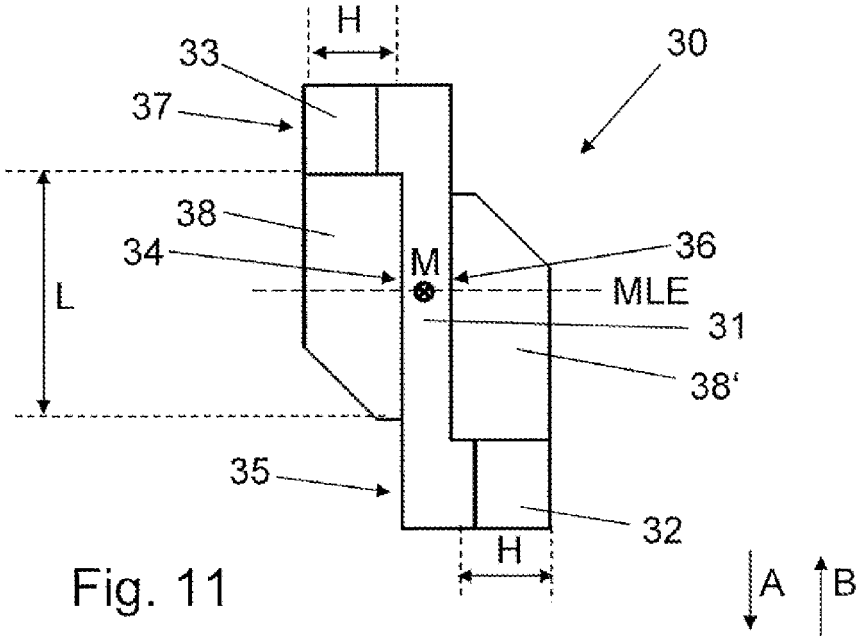
FIG. 11 shows the skid segment shown in FIG. 10 in a schematic front view.

FIG. 11 shows the skid segment 30 shown in FIG. 10 in a schematic front view counter to the feed direction V. The geometrical body of the skid segment 30 is of point-symmetrical design with respect to the center M of the body. This is also apparent from FIG. 10, in which the center M of the body is likewise depicted.

As FIG. 11 shows, the second skid section 33 is attached to the first side 34 of the base part 31, in the upper region 37 thereof, and the first skid section 32 is attached to the second side 36 of the base part 31, in the lower region 35 thereof. In this case, the first and second skid sections 32 and 33 form a profile of substantially Z-shaped cross section together with the base part 31. The base part 31 forms a profile of rectangular cross section extending along the edge protection 5.

Figure 12:
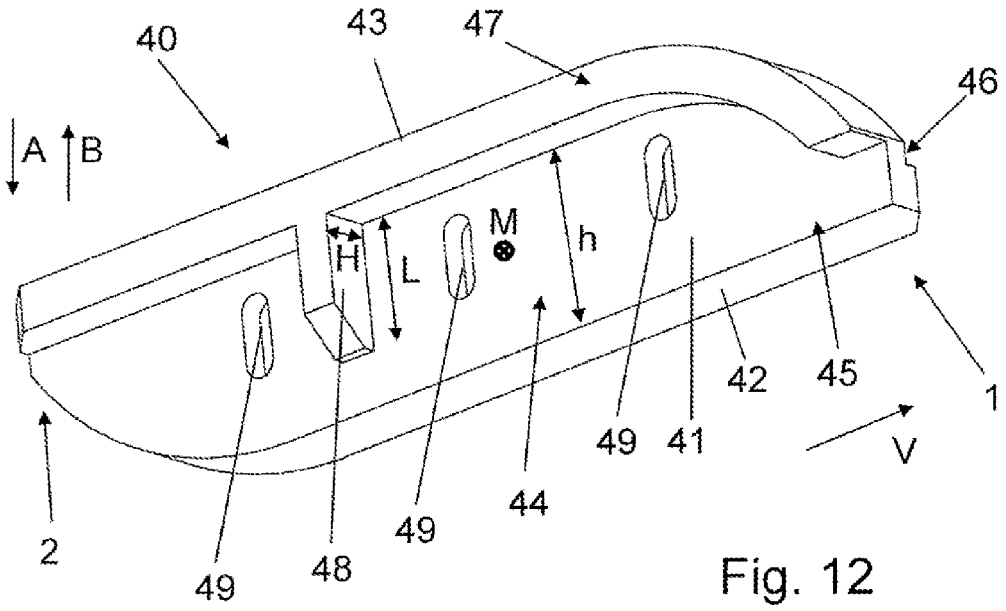
FIG. 12 shows the skid segment shown in FIG. 8 and skid sections extending along a curved path in a schematic and perspective side view.

FIG. 12 shows the skid segment 40 shown in FIG. 8 and having first and second skid sections 42 and 43 extending along a curved path in a schematic and perspective side view. In the orientation, shown in FIG. 12, of the first operating position, the first skid section 42 attached to the second side 46 of the base part 41, on the lower region 45 thereof, is aligned in the direction A of the road or ground surface. In the orientation, shown in FIG. 12, of the first operating position, the second skid section 43 attached to the first side 44 of the base part 41, on the upper region 47 thereof, is aligned in the direction B away from the road or ground surface. In the second operating position, which is not shown in FIG. 12, the second skid section 43 would be aligned in the direction A of the road or ground surface.

At the first end 1 facing in the feed direction V, the second skid section 43 extends along a curved path in a direction toward the first skid section 42, whereas, at the end 2 facing counter to the feed direction V, the first skid section 42 extends along a curved path in a direction toward the second skid section 43. The section of the second skid section 43 in the region of the second end 2 extends parallel to the section of the first skid section 42 in the region of the first end 1. Here, the shape of the base part 41 follows the curved paths of the first and the second skid section 42 and 43.

A reinforcing strut 48, which is spaced apart from the second end 2 in the feed direction V, is arranged on the skid segment 40, between the second skid section 43 and the base part 41, on the first side 44 of the base part 41. The reinforcing strut 38 projects relative to the base part 41 at the same height H as the second skid section 43 projects relative to the base part 41. The reinforcing strut 48 extends perpendicularly to the second skid section 43 over a length L which is shorter than the height h of the first side 44 of the base part 31 perpendicularly to the straight section of the skid section 43.

A reinforcing strut 48' is likewise arranged on the skid segment 40, between the first skid section 42 and the base part 41, on the second side 46 of the base part 41. In the illustration in FIG. 12, however, this reinforcing strut is not visible since it is concealed by the base part 41. However, the reinforcing strut 48' is illustrated in FIG. 13.

The reinforcing struts 48 are spaced apart from the two ends of the skid segment 40 in the feed direction V. At the first end 1 of the skid segment 40, the first skid section 42 is of beveled design perpendicularly to the feed direction V. At the second end 2 of the skid segment 40, the second skid section 43 is of beveled design perpendicularly to the feed direction V.

Two screw sockets 49 spaced apart from one another in the feed direction V are formed in the base part 41 on both sides of the reinforcing strut 48, on the first side 44, and a third screw socket 49 is formed close to the first end 1. The screw sockets 49 are introduced into the base part 41 as drill holes with a drilling direction substantially parallel to the central longitudinal plane MLE. In this case, the screw sockets 49 are designed as a slotted holes which, in turn, extend substantially perpendicularly to the central longitudinal plane MLE or transversely thereto.

Figure 13:
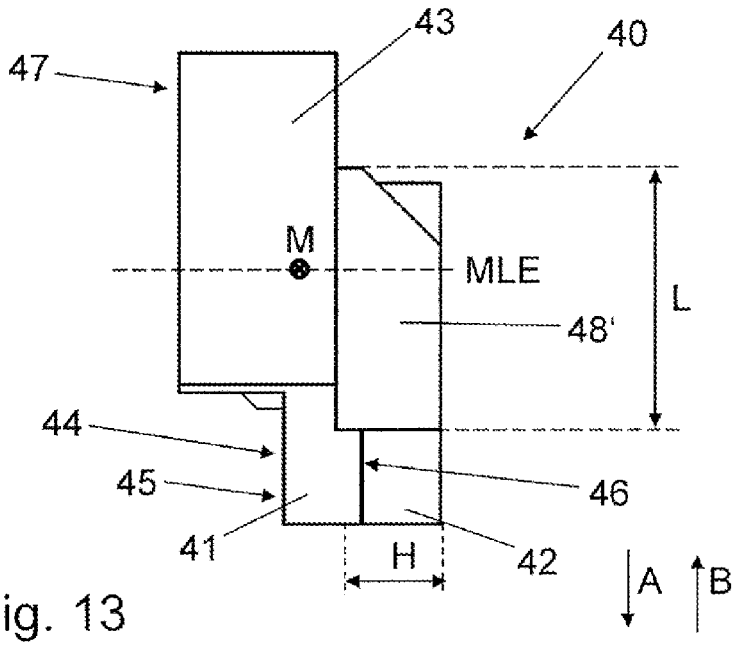
FIG. 13 shows the skid segment shown in FIG. 12 in a schematic front view counter to the feed direction.

FIG. 13 shows the skid segment 40 shown in FIG. 12 in a schematic front view counter to the feed direction V. The geometrical body of the skid segment 40 is of point-symmetrical design with respect to the center M of the body. This is also apparent from FIG. 12, in which the center M of the body is likewise depicted.

As FIG. 13 shows, the second skid section 43 is attached to the first side 44 of the base part 41, in the upper region 47 thereof, the first skid section 42 is attached to the second side 46 of the base part 41, in the lower region 45 thereof. In this case, the mutually parallel sections of the first and second skid sections 42 and 43 form a profile of substantially Z-shaped cross section together with the base part 31. In the region of the parallel sections of the first and second skid sections 42 and 43, the base part 31 forms a profile of rectangular cross section extending along the edge protection 5.

Figure 14:
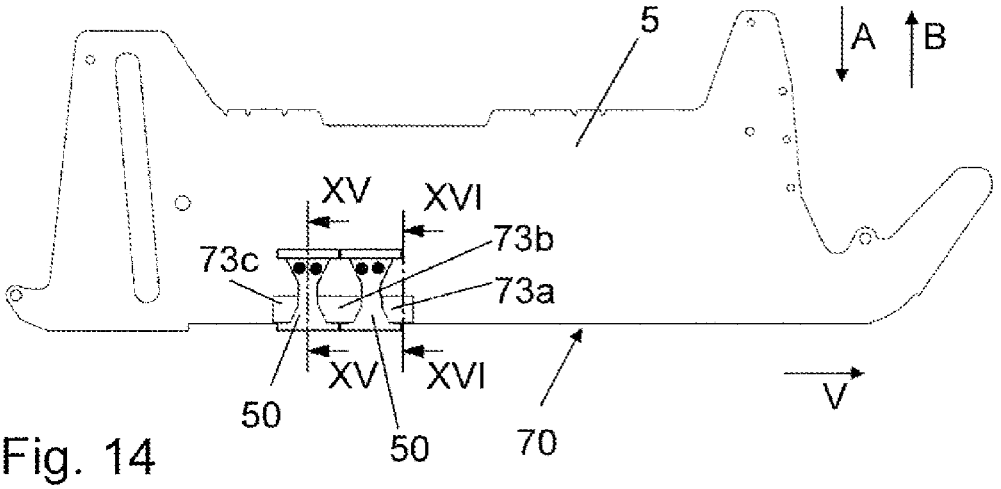
FIG. 14 shows the edge protection shown in FIG. 1 with two skid segments according to a third embodiment arranged in series on its lower edge in a schematic side view.

FIG. 14 shows the edge protection 5 shown in FIG. 1 with two skid segments 50 according to a third embodiment arranged in series on its lower edge 70 in a schematic side view. The skid segments 50, which are of identical design, are mounted in a first operating position. The edge 70 has clamping elements 73*a*, 73*b* and 73*c* forming plug sockets to receive the skid segment 50. The clamping elements 73*a*, 73*b* and 73*c* are described in greater detail below, more particularly with reference to FIGS. 20 and 21.

One of the skid segments 50 is described in greater detail below with reference to FIGS. 15 to 19.

Figure 15:
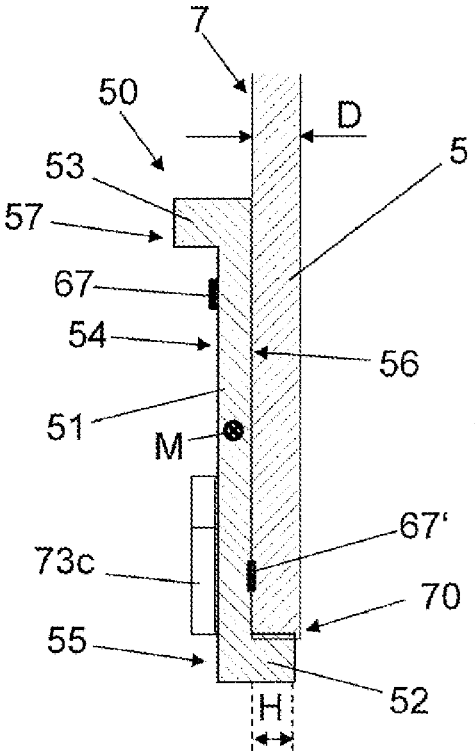
FIG. 15 shows a skid segment shown in FIG. 14 in a schematic sectional view along section line XV-XV.
Figure 16:
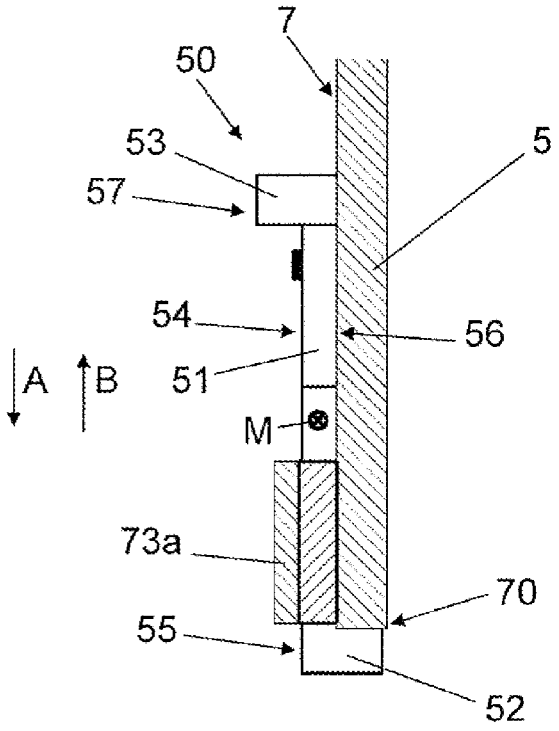
FIG. 16 shows a skid segment shown in FIG. 14 in a schematic sectional view along section line XVI-XVI.

FIG. 15 shows the skid segment 50 shown on the left in FIG. 14 in a schematic sectional view along section line XV-XV. FIG. 16 shows the identical skid segment 50 shown on the right in FIG. 14 in a schematic sectional view along section line XVI-XVI.

In FIGS. 15 and 16, the skid segment 50 is illustrated as mounted in a first operating position. The skid segment 50 has a base part 51 of substantially rectangular cross section. A first skid section 52 is arranged on the bottom of the base part 51, and a second skid section 53 is arranged on the top thereof. The first skid section 52 projects to the right at right angles beyond the second side 56 of the base part 51, the side on the right in FIG. 15. The second skid section 53 projects to the left at right angles beyond the first side 54 of the base part 51, the side on the left in FIG. 15. The base part 31 is formed integrally with the first and the second skid section 52 and 53 from a metal, preferably cast steel. The lower side of the first skid section 52 and the upper side of the second skid section 53 are of substantially level design.

The base part 51 has a second side 56, which faces away from the first side 54 and, in the first operating position shown in FIG. 15, forms a fastening side having a supporting surface. By means of the supporting surface of the second side 56, the base part 51 rests against the edge 70 of the edge protection 5 and is mounted thereon. In the first operating position shown in FIG. 15, the first skid section 52 covers the edge 70 of the edge protection 5 at the bottom relative to the road or ground surface (not shown) situated in direction A.

The geometrical body of the skid segment 50 is of point-symmetrical design with respect to the center M of the body. This is also apparent from the subsequent FIGS. 16, 18 and 19, in which the center M of the body is likewise depicted.

As can be seen by comparing FIGS. 15 and 16, clamping elements 73*c* and 73*a* engage from the left on the first side 54 in the lower region of the base part 51. Clamping elements 73*a* and 73*c* are described in greater detail below, more particularly with reference to FIGS. 20 and 21. Clamping elements 73*c* and 73*a* fix the skid segment 50 in the first operating position, which is shown in FIG. 15. A rubber element 67' attached to the base part acts between the second side 56 of the base part 51 and the outer side 7 of the edge protection 5. By means of a contact pressure, which is applied to the base part 51 by clamping elements 73*c* and 73*a* in the direction of the edge protection 5, the rubber element 67' is compressed and thus assists the fixing of the skid segment 50 in the first operating position.

The skid segment 50 can also be mounted in a second operating position (not shown). In the second operating position, the skid segment 50 is rotated through 180° or mounted in such a way as to be inverted as compared with the first operating position shown in FIG. 15. As a result, the first skid section 52 faces upward in direction B in the second operating position, whereas the second skid section 53 faces downward in direction A. Thus, in the second operating position, the second skid section 53 covers the edge 70 of the edge protection 5 at the bottom.

The first skid section 52 and the second skid section 53 each project from the base part 51 by a height H, which corresponds substantially to the thickness D of the edge protection 5 in the illustration in FIG. 15. As an alternative, the height H selected can also be greater or smaller than the thickness D.

Figure 17:
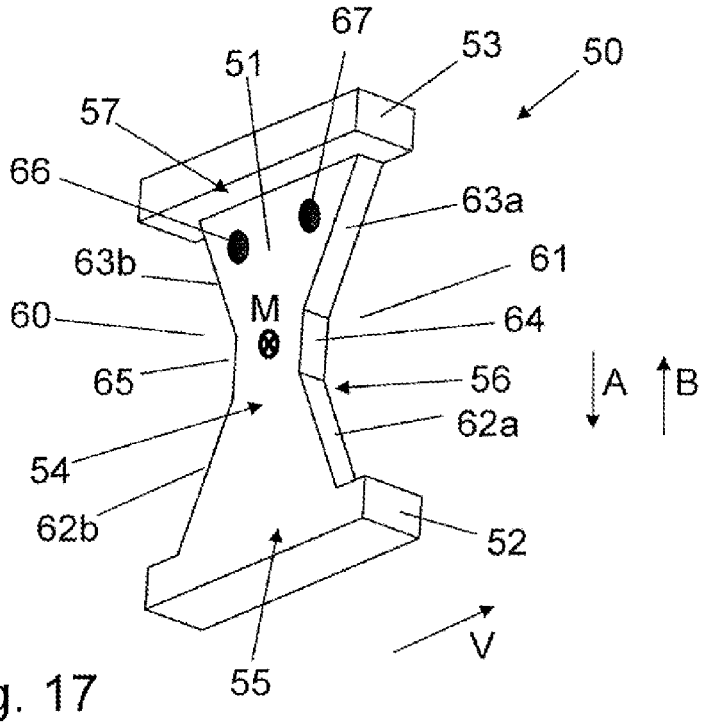
FIG. 17 shows a skid segment shown in FIG. 14 in a schematic and perspective side view.

FIG. 17 shows one of the skid segments 50 shown in FIG. 14 in a schematic and perspective side view. In the illustration in FIG. 17, the skid segment 50 is illustrated in the orientation of the first operating position.

The base part 51 has two laterally drawn-in regions 60 and 61. The laterally drawn-in region 60 illustrated on the left in FIG. 17 forms an approximately V-shaped recess, which is delimited substantially by two inward-sloping partial regions 62*b* and 63*b*. The laterally drawn-in region 61 illustrated on the right in FIG. 17 likewise forms an approximately V-shaped recess, which is delimited substantially by two inward-sloping partial regions 62*a* and 63*a*. The inward-sloping partial regions 62*b*, 63*b* and 62*a*, 63*a* form the legs of the V shape.

A partial region 65, which extends perpendicularly to the first and second skid sections 52 and 53, extends in the trough of the V shape, between the inward-sloping partial regions 62*b* and 63*b*. A partial region 64, which extends perpendicularly to the first and second skid sections 52 and 53, likewise extends in the trough of the V shape, between the inward-sloping partial regions 62*a* and 63*a*. In this case, partial regions 64 and 65 extend parallel to one another.

Two rubber elements 66 and 67 spaced apart from one another and from the second skid section 53 are arranged in the upper region 57 of the first side 54 of the skid segment 50. Two rubber elements spaced apart from one another and from the first skid section 52, of which the rubber element with the reference sign 67' is illustrated in FIG. 18, are arranged on the second side 56 of the skid segment 50, the side which is not visible in FIG. 17.

Figure 18:
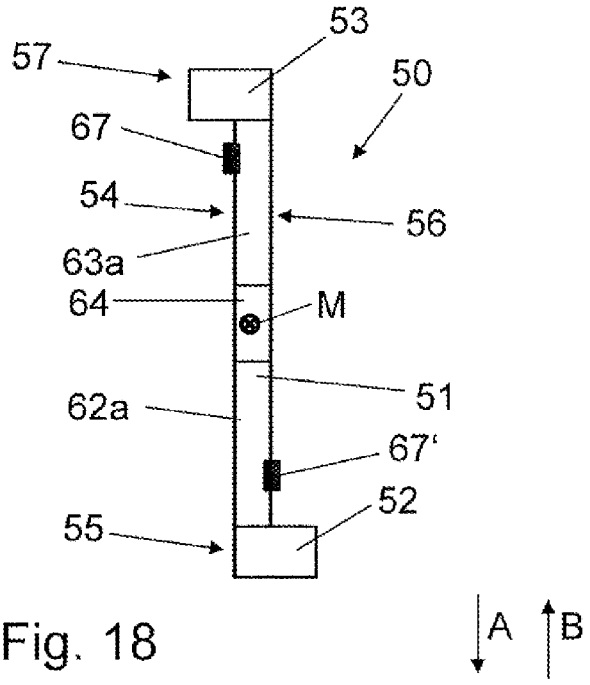
FIG. 18 shows the skid segment shown in FIG. 17 in a schematic front view counter to the feed direction.

FIG. 18 shows the skid segment 50 shown in FIG. 17 in a schematic front view counter to the feed direction. The second skid section 53 is attached to the first side 54 of the base part 51, in the upper region 57 thereof, and the first skid section 52 is attached to the second side 56 of the base part 51, in the lower region 55 thereof. In this case, the first and second skid sections 52 and 53 form a profile of substantially Z-shaped cross section together with the base part 51.

Figure 19:
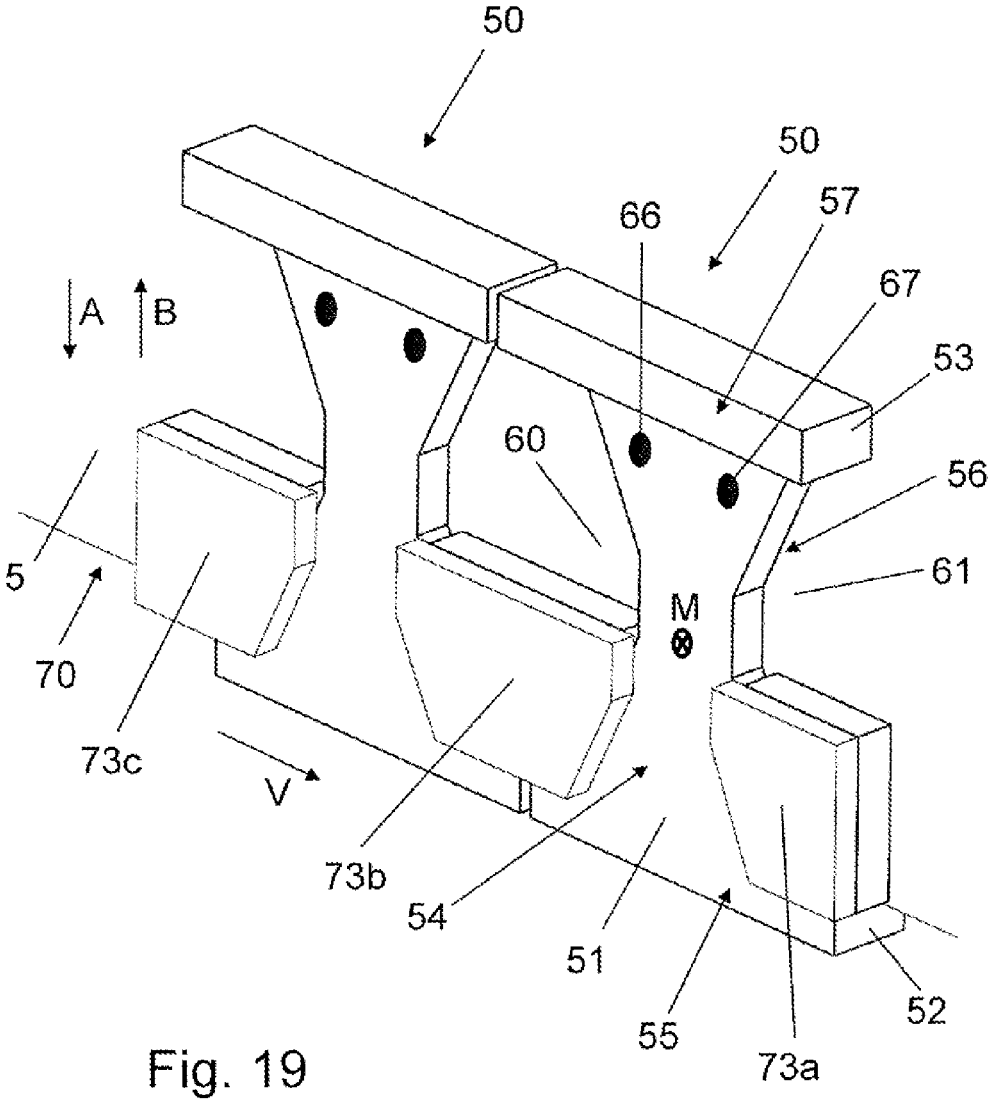
FIG. 19 shows an enlarged partial region of the edge protection shown in FIG. 14 in a schematic and perspective side view.

FIG. 19 shows an enlarged partial region of the edge protection 5 shown in FIG. 14 in a schematic and perspective side view. Clamping elements 73*a*, 73*b* and 73*c* for receiving two skid segments 50 are arranged on the edge 70 of the edge protection. The two skid segments 50 illustrated are fixed in the first operating position by means of the clamping elements 73*a*, 73*b* and 73*c*.

The lower region of the skid segment 50 is held positively between clamping elements 73*a* and 73*b*. Clamping elements 73*a* and 73*b* are of complementary design to inward-sloping partial regions 62*b* and 62*a*, respectively, of the base part 51. Clamping elements 73*b* and 73*c* are likewise of complementary design to inward-sloping partial regions 62*b* and 62*a*, respectively, of the base part 51. Respective pairs of mutually spaced clamping elements 73*a*, 73*b* and 73*b*, 73*c* act respectively on both sides of inward-sloping partial regions 62*b* and 62*a*, respectively, of the base part 51.

In the embodiment shown in FIG. 19, clamping elements 73*a* and 73*c* serve to receive just one skid segment 50 on one side in each case, whereas the clamping element 73*b* arranged between them serves to receive two skid segments 50.

Figure 20:
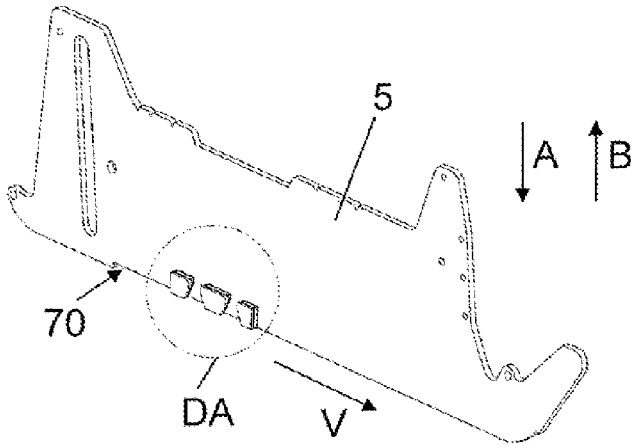
FIG. 20 shows the edge protection shown in FIG. 14 with the skid segments removed in a schematic and perspective side view.
Figure 21:
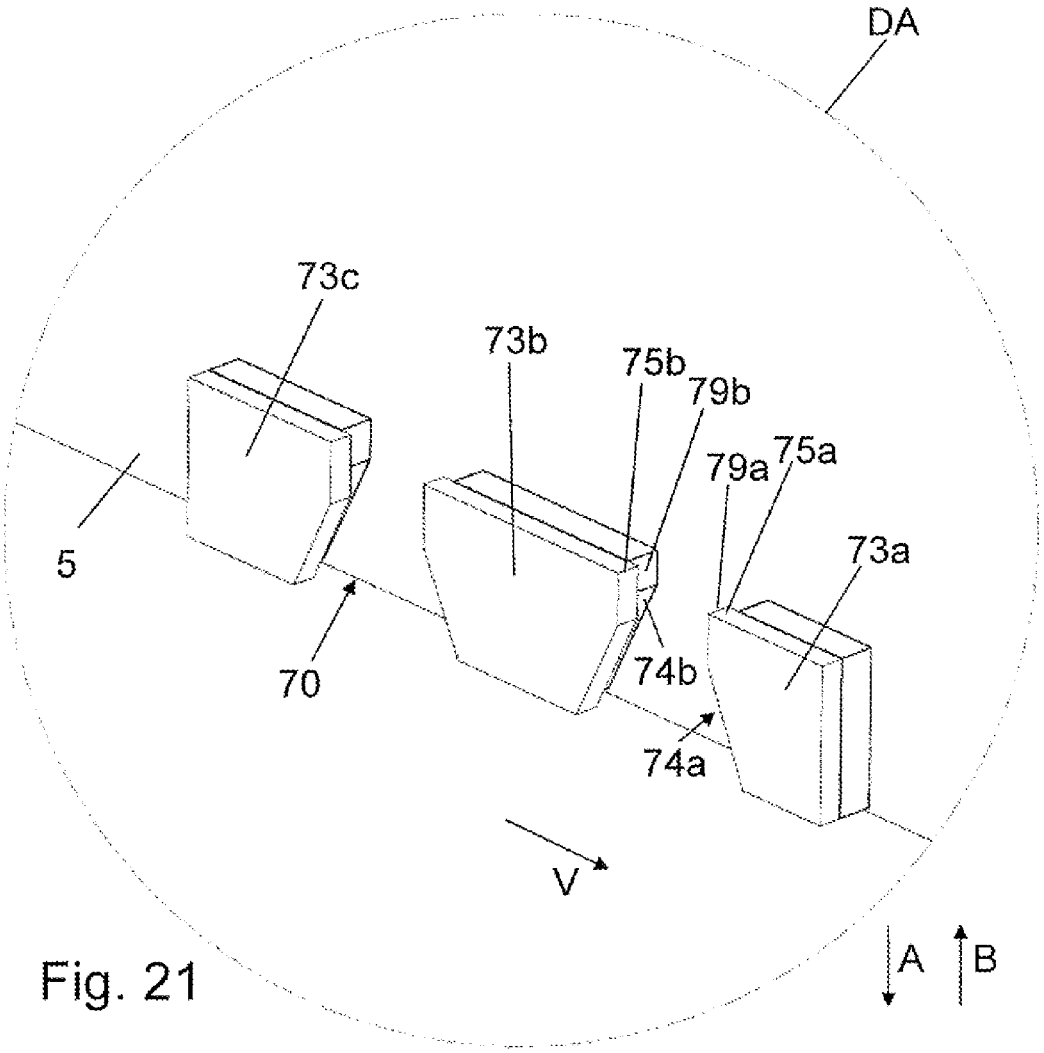
FIG. 21 shows the edge protection shown in FIG. 20 in a schematic and perspective side view and in an enlarged detail view DA.

FIG. 20 shows the edge protection 5 shown in FIG. 14 with the skid segments 50 removed in a schematic and perspective side view. FIG. 21 shows the edge protection 5 shown in FIG. 20 in a schematic and perspective side view and in an enlarged detail view DA.

Clamping elements 73*a* and 73*b* have stop surfaces 74*a* and 74*b* which extend substantially parallel to inward-sloping partial regions 62*a* and 62*b* of the base part 51 and which are in positive engagement with the inward-sloping partial regions 62*a* and 62*b* of the base part 51 in the state of installation in the first operating position. In the second operating position, stop surfaces 74*a* and 74*b* are in engagement with inward-sloping partial regions 63*a* and 32*b* of the base part 51.

Undercuts 75*a* and 75*b* that partially enclose the base part are formed on clamping elements 73*a* and 73*b*. Undercuts 75*a* and 75*b* support the base part in a direction toward the edge protection 5, whereas stop surfaces 74*a* and 74*b* align the base part in a stable position in the respective operating position.

Both the undercuts 75*a* and 75*b* and the stop surfaces 74*a* and 74*b* have sections 79*a* and 79*b* that are parallel to partial regions 64 and 65 of the base part 51.

During installation in the first operating position, the skid segment 50 is placed against clamping elements 73*a* and 73*b* with a small offset downward in direction A, with the result that the parallel sections 79*a* and 79*b* reach through the laterally drawn-in regions 60 and 61 of the base part 51. The skid segment 50 is then pushed upward from below behind undercuts 75*a* and 75*b* until inward-sloping partial regions 63*a* and 32*b* of the base part 51 strike against stop surfaces 74*a* and 74*b*. During this process, the rubber elements 67' arranged in this region come into contact with the edge detection, while exerting pressure.

The invention claimed is:

1. A skid segment for a side plate of a ground working machine for working a ground surface, the skid segment comprising:

a base part; and at least one first skid section attached to the base part and at least one second skid section attached to the base part, the first and second skid sections being configured such that:

in a first operating position of the base part relative to the side plate, the first skid section can be faced toward the ground surface for engagement with the ground surface; and in a second operating position of the base part relative to the side plate, the second skid section can be faced toward the ground surface for engagement with the ground surface;

wherein:

the base part includes a first side and a second side, the second side facing away from the first side;

the at least one first skid section is attached to the second side of the base part in a lower region of the second side of the base part;

in the first operating position the second side of the base part forms a fastening side including at least one supporting surface;

the at least one second skid section is attached to the first side of the base part in an upper region of the first side of the base part; and the first and second skid sections together with the base part form a substantially Z-shaped cross section.

2. The skid segment of claim 1, wherein:

the base part includes a first end and a second end, the first end facing in a feed direction of the ground working machine;

the second skid section and the base part extend along a curved path in a direction toward the first skid section and toward the first end of the base part; and the first skid section and the base part extend along a curved path in a direction toward the second skid section and toward the second end of the base part.

3. The skid segment of claim 1, wherein:

the skid segment is of point-symmetrical design with respect to a center of the skid segment.

4. The skid segment of claim 1, wherein:

the base part has a rectangular cross-section configured to extend along the side plate at least in some portion of the base part.

5. The skid segment of claim 1, wherein:

the base part includes at least one screw socket formed in the base part.

6. The skid segment of claim 5, wherein:

the at least one screw socket includes a slotted hole extending substantially perpendicularly to a central longitudinal plane of the skid segment.

7. A skid segment for a side plate of a ground working machine for working a ground surface, the skid segment comprising:

a base part;

at least one first skid section attached to the base part and at least one second skid section attached to the base part, the first and second skid sections being configured such that:

in a first operating position of the base part relative to the side plate, the first skid section can be faced toward the ground surface for engagement with the ground surface; and in a second operating position of the base part relative to the side plate, the second skid section can be faced toward the ground surface for engagement with the ground surface;

at least one reinforcing strut arranged between the base part and the first skid section; and at least one reinforcing strut arranged between the base part and the second skid section.

8. The skid segment of claim 7, wherein:

the base part includes a first side and a second side, the second side facing away from the first side;

the at least one first skid section is attached to the first side of the base part in a lower region of the first side of the base part; and in the first operating position of the base part relative to the side plate, the second side of the base part forms a fastening side including at least one supporting surface.

9. The skid segment of claim 7, wherein:

the base part includes a first side and a second side, the second side facing away from the first side;

the at least one first skid section is attached to the first side of the base part in a lower region of the first side of the base part;

the at least one second skid section is attached to the first side of the base part in an upper region of the first side of the base part; and the first and second skid sections together with the base part form a profile with a substantially U-shaped cross section.

10. The skid segment of claim 9, wherein:

the first skid section and the second skid section taper toward one another along curved paths to form a tapered first end of the skid segment facing in a feed direction of the ground working machine.

11. The skid segment of claim 7, wherein:

the skid segment is of symmetrical design with respect to a central longitudinal plane extending in a feed direction of the ground working machine.

12. A skid segment for a side plate of a ground working machine for working a ground surface, the skid segment comprising:

a base part; and at least one first skid section attached to the base part and at least one second skid section attached to the base part, the first and second skid sections being configured such that:

in a first operating position of the base part relative to the side plate, the first skid section can be faced toward the ground surface for engagement with the ground surface; and in a second operating position of the base part relative to the side plate, the second skid section can be faced toward the ground surface for engagement with the ground surface;

wherein the base part includes two drawn-in regions laterally recessed toward each other, the drawn-in regions each merging into two inward-sloping partial regions from the first skid section in the direction of the second skid section and from the second skid section in the direction of the first skid section.

13. The skid segment of claim 12, wherein:

the two drawn-in regions of the base part include two substantially parallel partial regions formed between the two inward-sloping partial regions.

14. A side plate assembly for a ground working machine for working a ground surface, the side plate assembly comprising:

a side plate including an edge and a plurality of fastening sockets; and at least one skid segment attached to the side plate with at least one fastener received in at least one of the fastening sockets, the at least one skid segment including:

a base part; and at least one first skid section attached to the base part and at least one second skid section attached to the base part, the first and second skid sections being configured such that:

in a first operating position of the base part relative to the side plate, the first skid section can be faced toward the ground surface for engagement with the ground surface; and in a second operating position of the base part relative to the side plate, the second skid section can be faced toward the ground surface for engagement with the ground surface;

wherein:

the edge includes a bottom surface;

in the first operating position the first skid section covers the bottom surface of the edge; and in the second operating position the second skid section covers the bottom surface of the edge.

15. The side plate assembly of claim 14, wherein:

the plurality of fastening sockets includes at least one screw socket.

16. The side plate assembly of claim 14, wherein:

the plurality of fastening sockets includes at least one plug socket for positive retention of the at least one skid segment.

17. A side plate assembly for a ground working machine for working a ground surface, the side plate assembly comprising:

a side plate including an edge and a plurality of fastening sockets; and at least one skid segment attached to the side plate with at least one fastener received in at least one of the fastening sockets, the at least one skid segment including:

a base part; and at least one first skid section attached to the base part and at least one second skid section attached to the base part, the first and second skid sections being configured such that:

in a first operating position of the base part relative to the side plate, the first skid section can be faced toward the ground surface for engagement with the ground surface; and in a second operating position of the base part relative to the side plate, the second skid section can be faced toward the ground surface for engagement with the ground surface;

wherein the at least one skid segment includes at least one reinforcing strut arranged between the base part and the first skid section; and wherein the plurality of fastening sockets includes at least one socket configured to receive the at least one reinforcing strut.

18. The side plate assembly of claim 17, wherein:

in the first operating position the first skid section projects beyond the edge in the direction of the ground surface; and in the second operating position the second skid section projects beyond the edge in the direction of the ground surface.

19. A side plate assembly for a ground working machine for working a ground surface, the side plate assembly comprising:

a side plate including an edge and a plurality of fastening sockets; and at least one skid segment attached to the side plate with at least one fastener received in at least one of the fastening sockets, the at least one skid segment including:

a base part; and at least one first skid section attached to the base part and at least one second skid section attached to the base part, the first and second skid sections being configured such that:

in a first operating position of the base part relative to the side plate, the first skid section can be faced toward the ground surface for engagement with the ground surface; and in a second operating position of the base part relative to the side plate, the second skid section can be faced toward the ground surface for engagement with the ground surface;

wherein the plurality of fastening sockets includes at least one plug socket for positive retention of the at least one skid segment;

wherein the base part includes two drawn-in regions laterally recessed toward each other, the drawn-in regions each merging into two inward-sloping partial regions from the first skid section in the direction of the second skid section and from the second skid section in the direction of the first skid section; and wherein the at least one plug socket includes two mutually spaced clamping elements configured to act on both sides of the inward-sloping partial regions of the base part.

20. The side plate assembly of claim 19, wherein:

the clamping elements include stop surfaces extending substantially parallel to the inward-sloping partial regions of the base part; and the clamping elements include undercuts at least partially enclosing the base part.

* * * * *